US008022916B2

(12) United States Patent
Lee et al.

(10) Patent No.: US 8,022,916 B2
(45) Date of Patent: Sep. 20, 2011

(54) LIQUID CRYSTAL DISPLAY DRIVING DEVICE THAT REDUCES CROSSTALK

(75) Inventors: Sung-Hee Lee, Yongin-si (KR); Seoung-Bum Pyoun, Osan-si (KR)

(73) Assignee: Samsung Electronics Co., Ltd. (KR)

( * ) Notice: Subject to any disclaimer, the term of this patent is extended or adjusted under 35 U.S.C. 154(b) by 948 days.

(21) Appl. No.: 11/546,651

(22) Filed: Oct. 11, 2006

(65) Prior Publication Data

US 2007/0085800 A1 Apr. 19, 2007

(30) Foreign Application Priority Data

Oct. 13, 2005 (KR) ..... 10-2005-0096342

(51) Int. Cl.
*G09G 3/20* (2006.01)
*G09G 3/36* (2006.01)
*G09G 5/00* (2006.01)

(52) U.S. Cl. ..... 345/94; 345/58; 345/92; 345/98; 345/211

(58) Field of Classification Search ..... 345/92–100, 345/211–213, 58, 204
See application file for complete search history.

(56) References Cited

U.S. PATENT DOCUMENTS 5,283,477 A * 2/1994 Shibata ..... 327/306
5,576,729 A * 11/1996 Yamazaki ..... 345/94
5,638,087 A * 6/1997 Tanaka et al. ..... 345/87
5,796,296 A * 8/1998 Krzentz ..... 327/545
5,831,605 A * 11/1998 Yasui et al. ..... 345/211
6,392,626 B1 * 5/2002 Moon ..... 345/94
6,465,993 B1 * 10/2002 Clarkin et al. ..... 323/272
6,614,416 B1 * 9/2003 Yamamoto et al. ..... 345/94
2002/0024484 A1 * 2/2002 Lee et al. ..... 345/87
2003/0058204 A1 * 3/2003 Moon ..... 345/87
2005/0253836 A1 * 11/2005 Kim et al. ..... 345/212
2006/0244704 A1 * 11/2006 JaeHun ..... 345/92

FOREIGN PATENT DOCUMENTS

CN 1409292 A 4/2003

* cited by examiner

*Primary Examiner* — Bipin Shalwala
*Assistant Examiner* — Matthew Fry
(74) *Attorney, Agent, or Firm* — Innovation Counsel LLP

(57) ABSTRACT

A liquid crystal display driving device that reduces horizontal crosstalk and a liquid crystal display employing the driving device are presented. The driving device includes a common voltage generator that generates first and second common voltages, and the common voltage generator includes a first capacitor provided between a first terminal for outputting the first common voltage and a second terminal for outputting the second common voltage. Since the capacitor is provided between two output terminals of the two common voltages, it reduces the distortion components of the common voltages, thereby reducing horizontal crosstalk. The invention reduces the number of parts in the driving device conferring the added benefit of reduced manufacturing cost.

7 Claims, 6 Drawing Sheets

LIQUID CRYSTAL DISPLAY DRIVING DEVICE THAT REDUCES CROSSTALK

CROSS-REFERENCE TO RELATED APPLICATION

This application claims priority to and the benefit of Korean Patent Application No. 10-2005-0096342 filed in the Korean Intellectual Property Office on Oct. 13, 2005, the contents of which are incorporated herein by reference.

BACKGROUND OF THE INVENTION (a) Field of the Invention

The present invention relates to a liquid crystal display, and more particularly; to a common voltage generator of a liquid crystal display.

(b) Description of the Related Art

Typically, a liquid crystal display (LCD) includes two display panels having pixel electrodes and a common electrode, and a dielectric-anisotropic liquid crystal layer interposed between the two display panels. The pixel electrodes are arranged in a matrix configuration with rows and columns and are connected to switching elements such as thin film transistors (TFTs) such that data voltages are sequentially applied to rows of the pixel electrodes. The common electrodes are formed to cover an entire surface of the display panel, and a common voltage is applied to the common electrode. In a circuit diagram, the pixel electrodes, the common electrode, and the liquid crystal layer interposed therebetween form a liquid crystal capacitor, and the liquid crystal capacitor and the switching element connected to the liquid crystal capacitor serve as a basic unit of a pixel.

In the liquid crystal display, an electric field is formed in the liquid crystal layer by applying voltages to the two electrodes, and light transmission through the liquid crystal layer is controlled by adjusting the intensity of the electric field in the liquid crystal layer. Accordingly, a desired image is obtained. Often, the polarity of the data voltage with respect to the common voltage is inverted every frame, every row, or every pixel to prevent device deterioration that may result from applying the electric field to the liquid crystal layer in one direction for a long time.

The liquid crystal display includes a liquid crystal panel assembly that has pixels each having a switching element and display signal lines connected to the pixels, a data driver that applies corresponding data voltages to the pixels through the switching elements, a gray voltage generator that generates gray voltages and supplies the gray voltages to the data driver, and a common voltage generator that supplies the common voltage to the liquid crystal panel assembly.

A problem with the liquid crystal display is the formation of a parasitic capacitance between the gate and the drain of each switching element. Formation of the parasitic capacitance causes coupling of the common voltage with the data voltage, which results in the common voltage becoming higher or lower than the intended voltage. Therefore, a direct current is applied in the form of an alternating current, and different voltages are applied to the pixels. When the difference in the voltages applied to the pixels becomes large enough, stripe-shaped horizontal crosstalk is displayed on a screen. It is desirable to eliminate this horizontal crosstalk, as it deteriorates image quality.

SUMMARY OF THE INVENTION

The present invention provides a liquid crystal display driving device and a liquid crystal display with reduced crosstalk.

In one aspect, the invention is a device for driving a liquid crystal display that includes a common voltage generator that generates first and second common voltages. The common voltage generator includes a first capacitor provided between a first terminal for outputting the first common voltage and a second terminal for outputting the second common voltage.

The common voltage generator may further include an operational amplifier that has an inversion terminal, a non-inversion terminal, and an output terminal, wherein the output terminal is coupled to the first terminal. The common voltage generator may also include a second capacitor that has one end connected to a first voltage and the non-inversion terminal and the other end grounded, a first resistor that is connected to the inversion terminal and a second voltage, a second resistor that is connected to the inversion terminal and the first terminal, and a third resistor that is connected to a third voltage and the second terminal.

In another aspect, present invention is a liquid crystal display including the above driving device.

BRIEF DESCRIPTION OF THE DRAWINGS

The accompanying drawings briefly described below illustrate exemplary embodiments of the present invention, and together with the description, serve to explain the principles of the present invention.

DETAILED DESCRIPTION OF THE EMBODIMENTS

Figure 1:
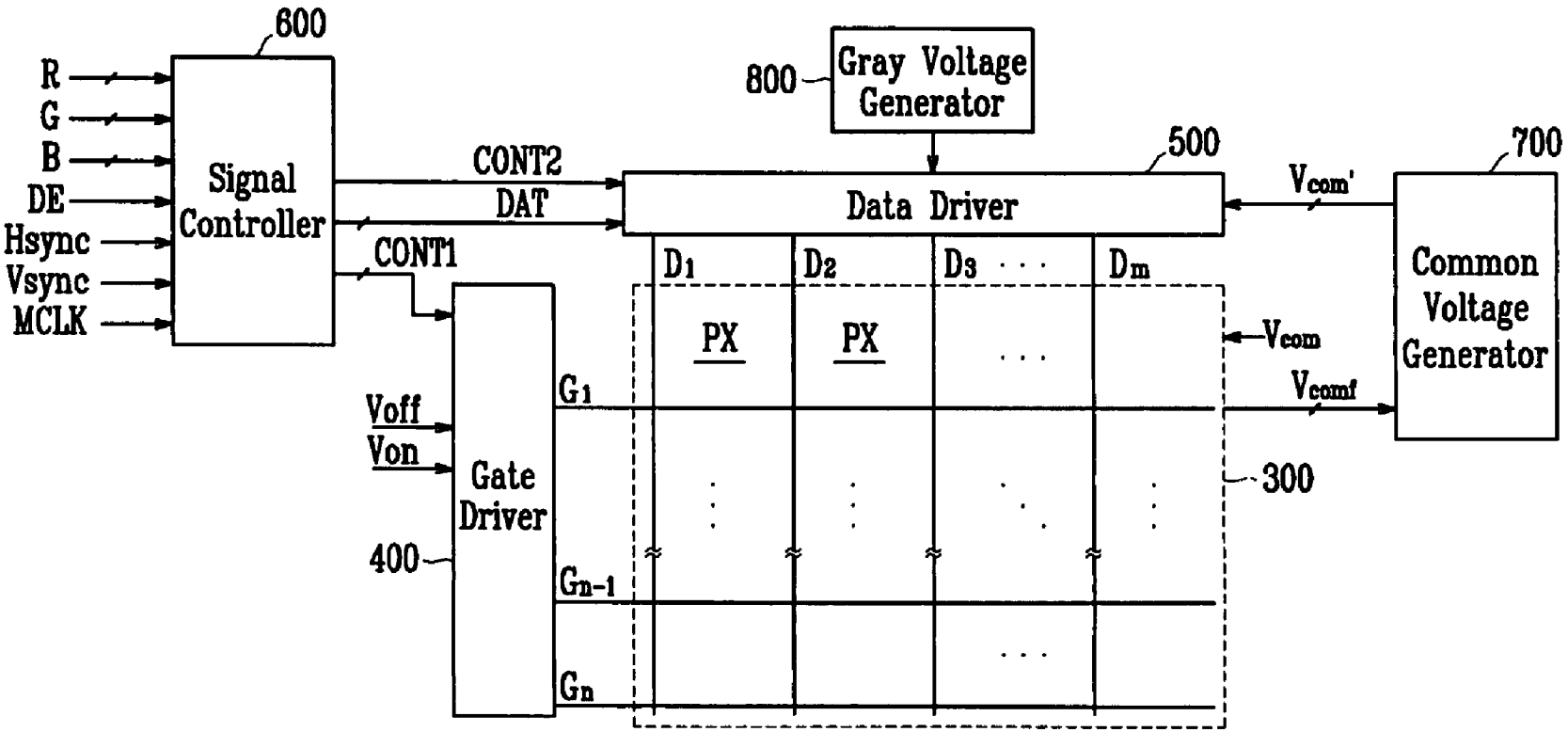
FIG. 1 is a block diagram of a liquid crystal display according to an exemplary embodiment of the present invention.

The present invention will be described more fully hereinafter with reference to the accompanying drawings, in which preferred embodiments of the invention are shown.

In the drawings, the thicknesses of layers, films, panels, regions, etc., are exaggerated for clarity. Like reference numerals designate like elements throughout the specification. It will be understood that when an element such as a layer, a film, a region, or a substrate is referred to as being "on" another element, it can be "directly on" another element or intervening elements may also be present therebetween. In contrast, when an element is referred to as being "directly on" another element, there are no intervening elements present therebetween.

First, a liquid crystal display according to an exemplary embodiment of the present invention will be described in detail with reference to FIGS. 1 to 3.

Figure 2:
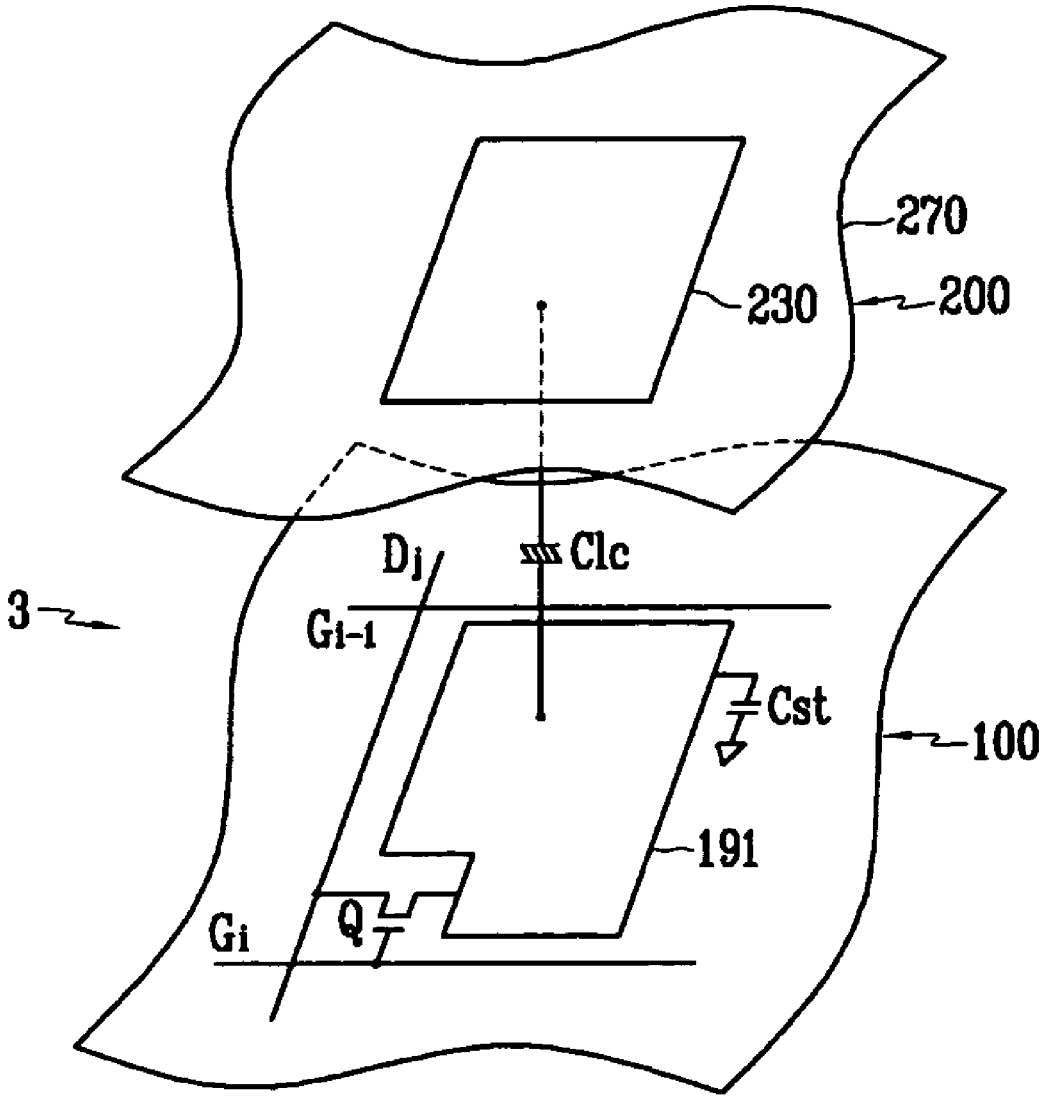
FIG. 2 is an equivalent circuit diagram of a pixel in the liquid crystal display according to the exemplary embodiment of the present invention.

FIG. 1 is a block diagram of a liquid crystal display according to an exemplary embodiment of the present invention. FIG. 2 is an equivalent circuit diagram of a pixel in the liquid crystal display according to the exemplary embodiment of the present invention, and FIG. 3 is a schematic layout view of the liquid crystal display according to the exemplary embodiment of the present invention.

As shown in FIG. 1, a liquid crystal display according to an exemplary embodiment of the present invention includes a liquid crystal panel assembly 300, a gate driver 400 and a data driver 500 connected to the liquid crystal panel assembly 300, and a gray voltage generator 800 connected to the data driver 500. A signal controller 600 controls these components.

In an equivalent circuit of the liquid crystal panel assembly, the liquid crystal panel assembly 300 includes a plurality of signal lines $G_1$ to $G_n$ and $D_1$ to $D_m$, and a plurality of pixels PX that are connected to the plurality of signal lines $G_1$ to $G_n$ and $D_1$ to $D_m$ and arranged substantially in a matrix configuration. In the structure shown in FIG. 2, the liquid crystal panel assembly 300 includes lower and upper panels 100 and 200 facing each other, and a liquid crystal layer 3 interposed therebetween.

The signal lines $G_1$ to $G_n$ and $D_1$ to $D_m$ include a plurality of gate lines $G_1$ to $G_n$ used to transmit gate signals (referred to as "scanning signals"), and a plurality of data lines $D_1$ to $D_m$ used to transmit data signals. The gate lines $G_1$ to $G_n$ extend substantially in a first direction and are substantially parallel to each other, and the data lines $D_1$ to $D_m$ extend substantially in a second direction and are substantially parallel to each other. The first and the second direction are substantially perpendicular to each other.

Each of the pixels PX, for example, a pixel PX connected to both an i-th (i=1,2, . . . , n) gate line $G_i$ and a j-th (j=1, 2, . . . , m) data line $D_j$ includes a switching element Q connected to signal lines $G_i$ and $D_j$, and a liquid crystal capacitor Clc and a storage capacitor Cst that are connected to the switching element Q. If desired, the storage capacitor Cst may be omitted.

The switching element Q is a three-terminal element such as a thin film transistor that is provided on the lower panel 100. A control terminal of the switching element Q is connected to the gate line $G_i$, an input terminal thereof is connected to the data line $D_j$, and an output terminal thereof is connected to both the liquid crystal capacitor Clc and the storage capacitor Cst.

The liquid crystal capacitor Clc has a pixel electrode 191 on the lower panel 100 and a common electrode 270 on the upper panel 200 that function as two terminals. The liquid crystal layer 3 interposed between the two electrodes 191 and 270 serves as a dielectric material. The pixel electrode 191 is connected to the switching element Q, and the common electrode 270 is formed on an entire surface of the upper panel 200. A common voltage Vcom is applied to the common electrode 270. Unlike the structure shown in FIG. 2, the common electrode 270 may be formed on the lower panel 100. In this case, at least one of the two electrodes 191 and 270 may be formed in the shape of a wire or rod.

The storage capacitor Cst is formed by a separate signal line (not shown) and the pixel electrode 191 sandwiching an insulator. A predetermined voltage such as the common voltage Vcom is applied to the separate signal line. In some embodiments, the storage capacitor Cst may be formed by the pixel electrode 191 and a previous gate line sandwiching an insulator.

Depending on the embodiment, colors images may be produced by spatial division or temporal division. In spatial division, each of the pixels PX is assigned a primary color and color is produced by activating certain pixels. In temporal division, each of the pixels PX alternately displays different primary colors at different times so that a desired color is displayed by controlling the color of each of the pixels. Typically, red, green, and blue are used as the primary colors although other color combinations may be used. FIG. 2 is a device that employs spatial division, as indicated by each of the pixels PX including a color filter 230 for displaying a primary color in the region of the upper panel 200 corresponding to the pixel electrode 191. Unlike the structure shown in FIG. 2, the color filter 230 may be formed on or beneath the pixel electrode 191 of the lower panel 100 in some emboidments.

At least one polarizer (not shown) for polarizing light is attached to the outer surface of the liquid crystal panel assembly 300.

Referring again to FIG. 1, the gray voltage generator 800 generates two gray voltage groups (or reference gray voltage groups) relating to the transmittance of the pixel PX. One of the two gray voltage groups has a positive value with respect to the common voltage Vcom, and the other gray voltage group has a negative value.

The gate driver 400 includes a plurality of gate driver ICs 440. Further, the gate driver 400 is connected to the gate lines $G_1$ to $G_n$ of the liquid crystal panel assembly 300 and applies gate signals, which are formed by combination of a gate-on voltage Von and a gate-off voltage Voff, to the gate lines $G_1$ to $G_n$.

The data driver 500 includes a plurality of data drivers ICs 540, and is connected to the data lines $D_1$ to $D_m$ of the liquid crystal panel assembly 300. In addition, the data driver 500 selects a gray voltage from the gray voltage generator 800 and applies the selected gray voltage to the data lines $D_1$ to $D_m$ as a data signal. When the gray voltage generator 800 does not provide voltages for all grayscales but provides only a predetermined number of reference gray voltages, the data driver 500 generates gray voltages for all grayscales by dividing the reference gray voltages and selects a data signal among the gray voltages for all grayscales.

Figure 4:
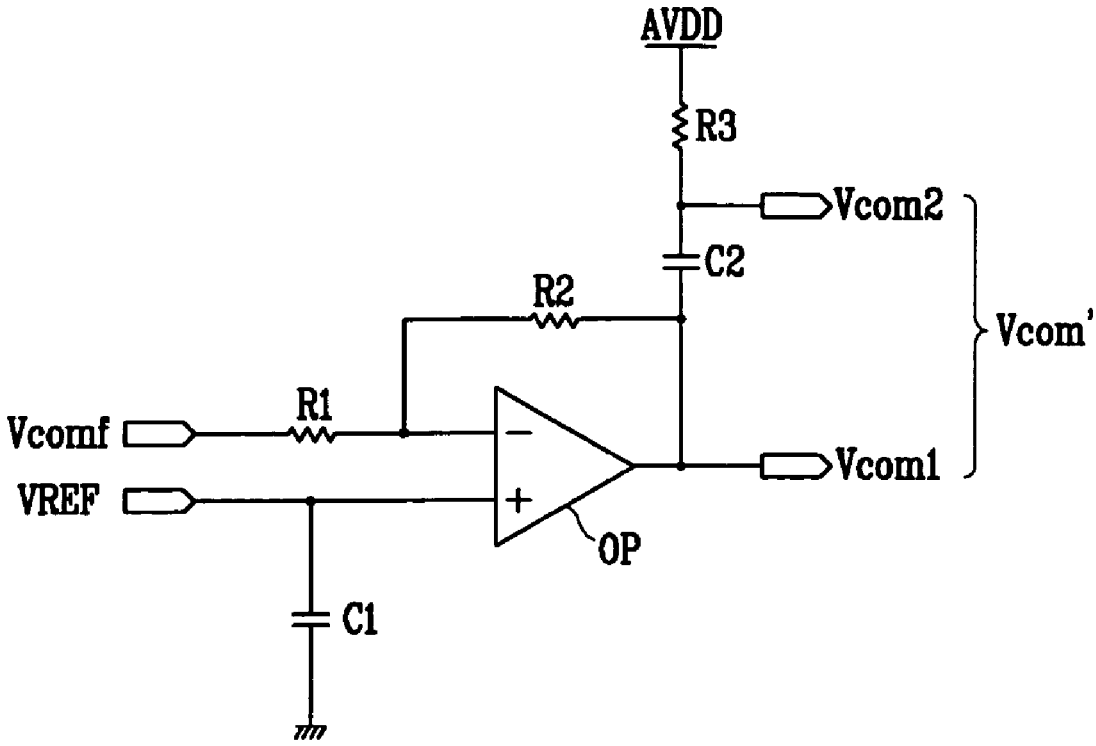
FIG. 4 is a circuit diagram of a common voltage generator of the liquid crystal display according to the exemplary embodiment of the present invention.

The common voltage generator 700 modifies a feedback voltage Vcomf derived from applied versions of the common voltage Vcom and applies those versions as a combined and modified set of voltage signals, Vcom' (where the latter includes Vcom1 and Vcom2 as shown in FIG. 4) to the liquid crystal panel assembly 300 through corresponding dummy pads (not shown) of the data driver ICs 540 and through corresponding short-circuit points SP1 to SP2 connected to the dummy pads.

The signal controller 600 controls the gate driver 400, the data driver 500, and the like.

Figure 3:
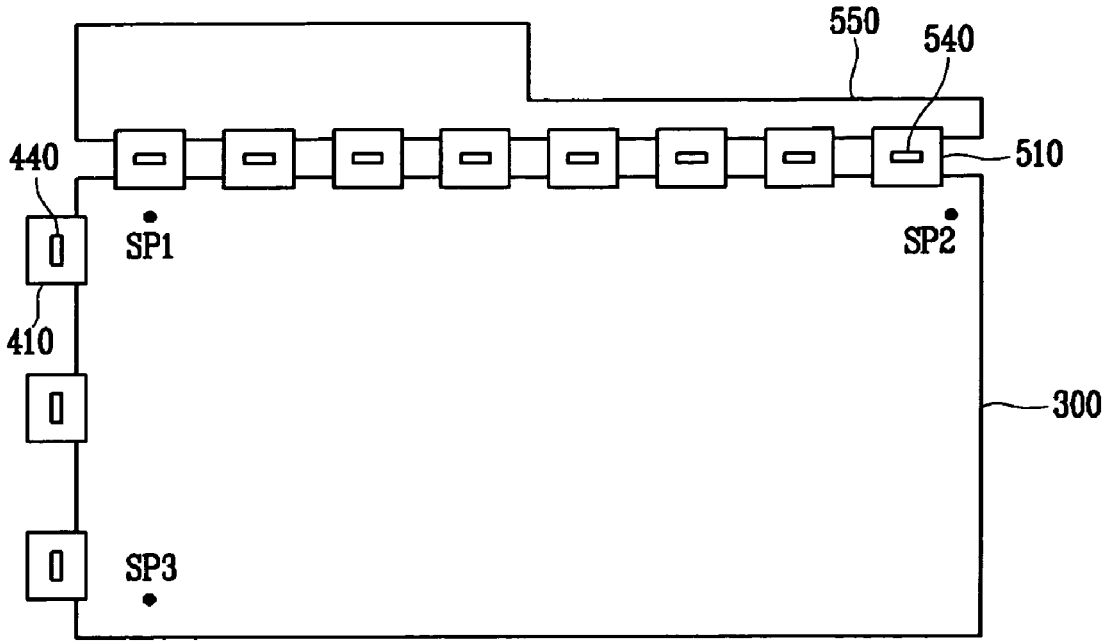
FIG. 3 is a schematic layout view of the liquid crystal display according to the exemplary embodiment of the present invention.

Some or all of the driving devices 400, 500, 600, 800 are mounted on flexible printed circuit film 410 or 510 as shown in FIG. 3 so as to be attached to the liquid crystal panel assembly 300 in the form of a TCP (tape carrier package). In some embodiments, some or all of the driving devices 400, 500, 600, 800 may be mounted on a separate printed circuit board (PCB) 550. Unlike the above-mentioned structure, the driving devices 400, 500, 600, 800 may be directly mounted on the liquid crystal panel assembly 300 in the form of at least one IC chip, or may be integrated on the liquid crystal panel assembly 300 together with the signal lines $G_1$, to $G_n$ and $D_1$ to $D_m$ and the thin film transistor switching elements Q. Further, the driving devices 400, 500, 600, and 800 may be integrated into a single chip. In this case, at least one of the drivers or at least one circuit element forming the drivers may be provided outside the single chip.

Hereinafter, the operation of the liquid crystal display will be described in detail.

The signal controller 600 receives input image signals R, G, and B from an external graphics controller (not shown), and input control signals for controlling the display of the input image signals R, G, and B. The input control signals may include a vertical synchronization signal Vsync, a horizontal synchronizing signal Hsync, a main clock signal MCLK, a data enable signal DE, and the like.

The signal controller 600 appropriately processes the input image signals R, G, and B using the input control signals so that the input image signals R, G, and B correspond to operating conditions of the liquid crystal panel assembly 300, and generates gate control signals CONT1, data control signals CONT2, and the like. Then, the signal controller 600 transmits the gate control signals CONT1 to the gate driver 400, and transmits the data control signals CONT2 and the processed image signals DAT to the data driver 500.

Each of the gate control signals CONT1 includes a scanning start signal STV for instructing the start of scanning, and at least one clock signal for controlling the output period of the gate-on voltage Von. In addition, the gate control signal CONT1 may further include an output enable signal OE for limiting the duration of the gate-on voltage Von.

Each of the data control signals CONT2 includes a horizontal synchronization start signal STH for directing the start of transmitting image data to a row (group) of pixels PX, and a load signal LOAD and a data clock signal HCLK for causing the data signals to be applied to the data lines $D_1$ to $D_m$. In addition, each of the data control signals CONT2 may further include an inversion signal RVS for inverting the voltage polarity of the data signal for the common voltage Vcom (hereinafter, "the voltage polarity of the data signal for the common voltage" is briefly referred to as "the polarity of the data signal").

The data driver 500 converts the digital image signals DAT into analog data signals by receiving the digital image signals DAT for a row (group) of pixels PX, and selecting respective gray voltages corresponding to the digital image signals DAT on the basis of the data control signals CONT2 from the signal controller 600. Then, the data driver 500 applies the analog data signals to corresponding data lines $D_1$ to $D_m$.

The gate driver 400 turns on the switching elements Q connected to the gate lines $G_1$ to $G_n$. by applying the gate-on voltage Von to the gate lines $G_1$ to $G_n$. on the basis of the gate control signal CONT1 from the signal controller 600. Accordingly, the data signals applied to the data lines $D_1$ to $D_m$ are applied to the corresponding pixels PX through the turned-on switching elements Q.

The difference between the voltage of the data signal applied to each pixel PX and the common voltage Vcom is represented as a voltage charged in the liquid crystal capacitor Clc, that is, a pixel voltage. Since the arrangement of the liquid crystal molecules changes depending on the level of the pixel voltage, the polarization of the light passing through the liquid crystal layer 3 also changes. The change in polarization in turn affects light transmittance of the polarizers attached to the display panel assembly 300.

The gate-on voltage Von is sequentially applied to all gate lines $G_1$ to $G_n$. and the data signals are applied to all pixels PX by repeating the above-mentioned processes for 1 horizontal period (which is represented as "1H", and is equal to one period of the horizontal synchronizing signal Hsync and the data enable signal DE). Accordingly, one frame of the image is displayed.

A display of a previous frame is completed, a display of a next frame begins, and the inversion signal RVS applied to the data driver 500 is controlled so that the data signal applied to each pixel PX has the polarity opposite in the polarity of the previous frame ("frame inversion"). In this case, even in one frame, the polarity of a data signal to be transmitted through one data line is changed (for example, row inversion, dot inversion) depending on the characteristic of the inversion signal RVS, or the polarities of data signals applied to one row of pixels may be changed (for example, column inversion, dot inversion).

Hereinafter, a common voltage generator of the display according to the exemplary embodiment of the present invention will be described in detail with reference to FIGS. 3 and 4-5B.

Figure 5A:
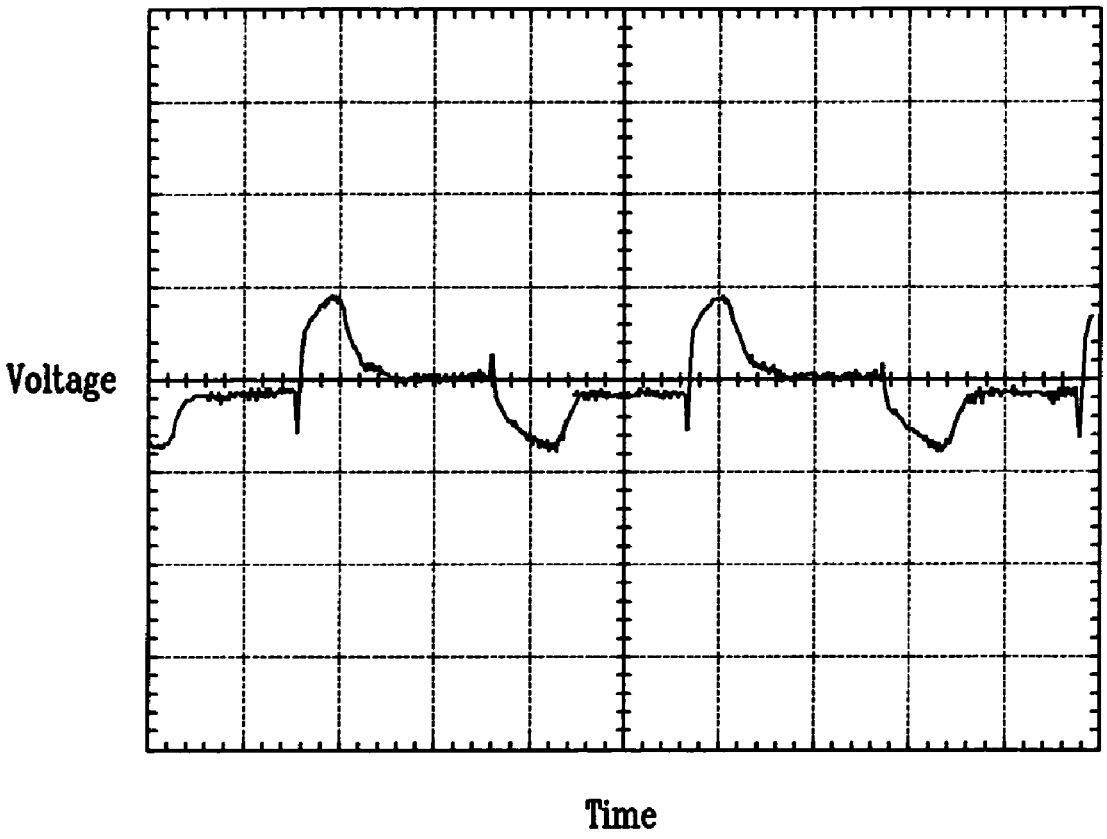
FIG. 5A and FIG. 5B are views showing a waveform of common voltage in the exemplary embodiment of the present invention and a waveform of common voltage in the related prior art, respectively.
Figure 5B:
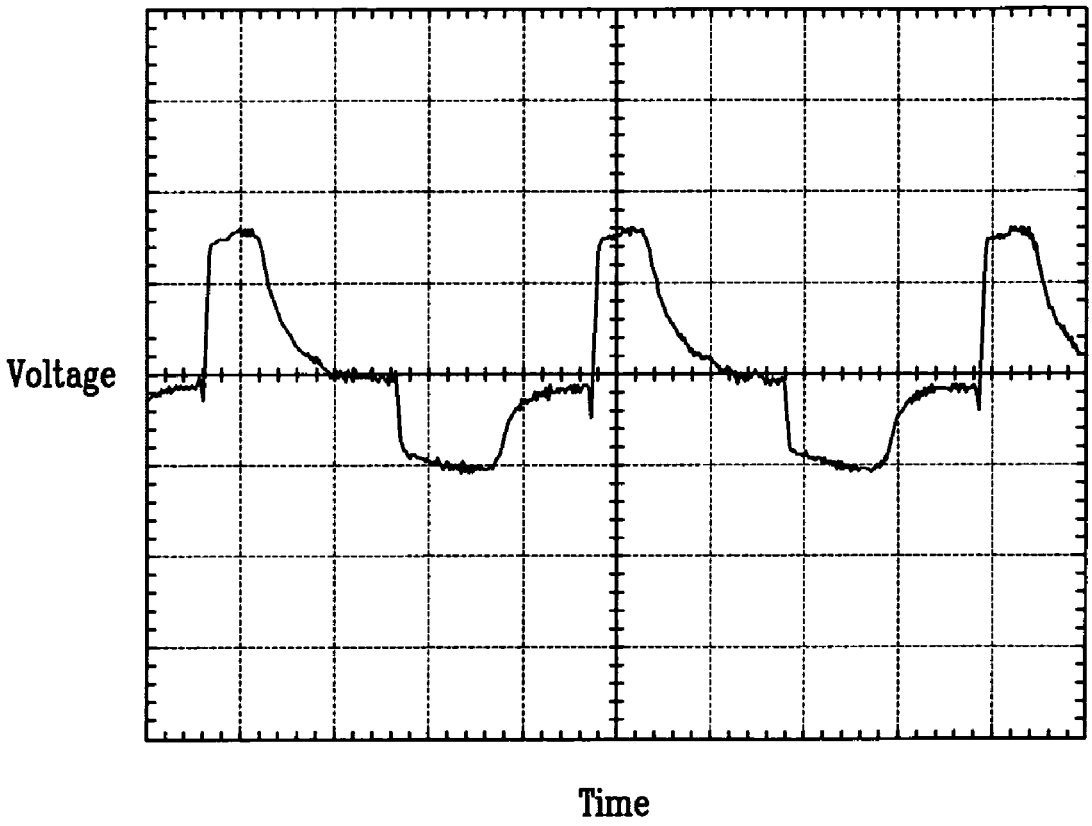
FIG.5B(Prior Art)

FIG. 4 is a circuit diagram of the common voltage generator 700 according to the exemplary embodiment of the present invention, and FIG. 5A and FIG. 5B are views showing a waveform of the common voltage in the exemplary embodiment of the present invention, and a waveform of the common voltage in the related prior art, respectively.

Referring to FIG. 4, the common voltage generator 700 according to the exemplary embodiment of the present invention includes an operational amplifier OP, a first capacitor C1, a second capacitor C2, a first resistor R1, a second resistor R2, and a third resistor R3. The first capacitor C1 has one end connected to a non-inversion terminal (+) of the operational amplifier OP and a reference voltage VREF and the other end grounded. The first resistor R1 is connected to an inversion terminal (−) of the operational amplifier OP and a feedback voltage (Vcomf), and the second resistor R2 is connected to an inversion terminal (−) of the operational amplifier OP and an output terminal. The third resistor R3 and the second capacitor C2 are connected in series between a source voltage AVDD and an output terminal of the operational amplifier OP.

The operational amplifier OP is a differential amplifier. The operational amplifier OP adjusts the difference between the reference voltage VREF and the feedback voltage Vcomf, and outputs the common voltages Vcom1 and Vcom2 that are results of processing the reference voltage VREF in light of the feedback voltage Vcomf. The common voltage Vcom1 is output from the output terminal of the operational amplifier OP, and the common voltage Vcom2 is output from a junction between the resistor R3 and the capacitor C2. In this case, the common voltage Vcom1 may be input through the short-circuit point SP1, and the common voltage Vcom2 may be input to the liquid crystal panel assembly 300 through the short-circuit point SP2.

The reference voltage VREF has substantially the same level as the common voltage Vcom first input to the liquid crystal panel assembly 300, and the feedback voltage Vcomf may be output through the short-circuit point SP3.

In this case, the common voltage Vcom2 is obtained by dividing the voltage between the source voltage AVDD and the common voltage Vcom1 with impedances of the resistor R3 and the capacitor C2. When the source voltage AVDD is constant and the common voltage Vcom1 has a constant alternating current component, the common voltage Vcom2 changes according to the common voltage Vcom1 so as to also have a constant alternating current component.

FIGS. 5A and 5B show the waveform of the common voltage Vcom2 for an embodiment of the invention and a conventional device, respectively. A comparision of FIGS. 5A and 5B indicates that the level of the common voltage Vcom2 generated by the common voltage generator 700 according to the exemplary embodiment of the present invention is generally lower than that of the common voltage in the conventional display device.

The waveforms of the common voltages shown in FIGS. 5A and 5B shows that the common voltage Vcom2 is coupled with the data voltage and changes at the rising edge and the falling edge of the data voltage due to the parasitic capacitance between the gate and the drain of the switching element Q. The waveforms show alternating maximum and minimum according to the data voltage inversion that occurs every pixel row, as described above. In the case of FIG. 5A, the common voltage Vcom1 is adjusted by the differential amplifier OP, e.g. in the manner shown in FIG. 4. In contrast, in the conventional device case of FIG. 5B, a resistor having substantially infinite resistance is used instead of the capacitor C2 and the source voltage AVDD is applied without adjustment. Therefore, the distortion of the common voltage caused by the Vcom2-data voltage coupling is hardly mitigated in FIG. 5B. In the present invention, since the capacitor C2 is placed between the Vcom1 and the source voltage AVDD instead of the infinite resistance, the source voltage AVDD is adjusted in connection with the common voltage Vcom1. In addition, since the capacitor C2 serves as a kind of a buffer, the distortion components of the common voltage Vcom2 are reduced more than in the conventional device. For this reason, the horizontal crosstalk is reduced.

Separate operational amplifiers are not needed for the common voltage Vcom2 and the common voltage Vcom1. Rather, the second capacitor C2 is provided between the output terminals of the common voltages Vcom1 and Vcom2. Accordingly, as an added benefit of the invention, the number of parts and the manufacturing cost can be reduced. Since the capacitor C2 is provided between the output terminals of the common voltages Vcom1 and Vcom2, the distortion components of the common voltage Vcom2 are reduced. As a result, the horizontal crosstalk can be reduced.

While this disclosure of invention has been provided in connection with what is presently considered to be practical exemplary embodiments, it is to be understood that the present teachings are not limited to the disclosed embodiments and they are intended to cover various modifications and equivalent arrangements included within the spirit and scope of the teachings.

What is claimed is:

1. A device for reducing crosstalk in a liquid crystal display (LCD) panel assembly where the LCD panel assembly includes a common electrode that capacitively couples to a plurality of pixel-electrodes and the pixel-electrodes are coupled to receive time-varying pixel data signals, the crosstalk reducing device comprising:

a common voltage generator that is coupled to the common electrode of the LCD assembly to receive a feedback signal from the common electrode and to output first and second common voltage signals to the common electrode, where each of the first and second common voltage signals as well as the feedback signal includes a respective AC (alternating current) component, where the first common voltage signal is functionally related to the feedback signal, and where the second common voltage signal is functionally related to an AC component of the first common voltage signal;

wherein the common voltage generator includes a negative feedback loop that operates to reduce the combined AC components of the feedback signal and of the first and second common voltage signals; and wherein the common voltage generator includes a first capacitor having first and second plates respectively connected to respective first and second output nodes that respectively have thereon the first common voltage signal and the second common voltage signal, said first capacitor causing the second common voltage signal to be functionally related to the AC component of the first voltage common voltage signal; wherein the common voltage generator voltage regulating circuit further includes:

an operational amplifier that has an inverting input terminal, a non-inverting input terminal, and an output terminal, wherein the output terminal of the operational amplifier is coupled to the first output node;

a second capacitor that has one end connected to receive a first reference voltage and that is further connected to the non-inverting input of the operational amplifier and where the other end of the second capacitor is grounded;

a first resistor that is connected to the inverting input terminal and is connected to receive at an opposed end thereof, a second voltage obtained from said feedback signal;

a second resistor that is directly connected to the inverting input terminal and to the first output node; and a third resistor that is directly connected to a third reference voltage and to the second output node.

2. The device for reducing crosstalk of claim 1, wherein the liquid crystal display panel assembly further includes a first substrate having defined thereon the plurality of pixel electrodes and a plurality of switching elements respectively connected to respective ones of the pixel electrodes.

3. The device for reducing crosstalk of claim 2, wherein:

the common electrode has spaced apart first and second short-circuit points provided thereon; and the first and second output nodes are coupled so as to apply the first and second common voltages respectively to the first and second short-circuit points of the common electrode.

4. The device for reducing crosstalk of claim 3, wherein:

the common electrode further has provided thereon a third short-circuit point spaced apart from each of the first and second short-circuit points; and the first resistor is connected so as to receive the second voltage from the third short-circuit point.

5. A liquid crystal display comprising:

a liquid crystal panel assembly that includes a common electrode, a plurality of pixel electrodes that are capacitively coupled to the common electrode, a plurality of switching elements respectively connected to respective ones of the pixel electrodes and a plurality of data lines coupled to the switching elements for transferring image data signals to the pixel-electrodes by way of the respective switching elements; and a common voltage generator coupled to the common electrode and configured to generate respective first and second common voltages for application to corresponding first and second short-circuit points on the common electrode, wherein the common voltage generator is configured to generate the first and second common voltages in response to a feedback signal received from a third short-circuit point on the common electrode, wherein the common voltage generator includes a first capacitor having first and second plates respectively connected to first and second output nodes of the common voltage generator, where the first and second output nodes respectively develop thereon, the first common voltage and the second common voltage; wherein the common voltage generator controller further includes:

an operational amplifier that has an inverting input terminal, a non-inverting input terminal, and an output terminal, wherein the output terminal of the operational amplifier is coupled to the first output node;

a second capacitor that has one end connected to receive a first reference voltage and that is further connected to the non-inverting input of the operational amplifier and where the other end of the second capacitor is grounded;

a first resistor that is connected to the inverting input terminal and is coupled to receive at an opposed end thereof, the feedback signal;

a second resistor that is directly coupled to the inverting input terminal and to the first output node; and a third resistor that is directly coupled to the second output node and a third reference voltage.

6. The liquid crystal display of claim 5, wherein the first and second short-circuit points are respectively provided at opposed sides of a same surface of the common electrode.

7. The liquid crystal display of claim 6, wherein the third short-circuit point is provided on the same surface of the common electrode but distally from both of the first and second short-circuit points.

* * * * *